United States Patent [19]
Clarke
[11] 4,147,498
[45] Apr. 3, 1979

[54] IGNITION ASSEMBLY FOR FLARE STACKS

[75] Inventor: Robert R. Clarke, Houston, Tex.
[73] Assignee: Clarke, Inc., Houston, Tex.

[21] Appl. No.: 759,014
[22] Filed: Jan. 13, 1977
[51] Int. Cl.² ..... F23D 13/20
[52] U.S. Cl. ..... 431/202; 136/230; 431/264; 422/168
[58] Field of Search ..... 431/202, 5, 264, 2; 110/1 F; 23/277 C; 136/230

[56] References Cited

U.S. PATENT DOCUMENTS

| | | | |
|---|---|---|---|
| 2,734,562 | 2/1956 | Haberle et al. | 431/202 X |
| 2,976,922 | 3/1961 | Bergman | 431/202 |
| 3,238,990 | 3/1966 | Von Linde et al. | 431/264 X |
| 3,667,408 | 6/1972 | Jasinsky et al. | 431/202 X |
| 3,671,169 | 6/1972 | Hroh et al. | 431/67 |
| 3,833,336 | 9/1974 | Ray | 431/202 |
| 3,849,058 | 11/1974 | Pankow | 431/264 |
| 3,975,212 | 8/1976 | Haupin et al. | 136/230 X |

*Primary Examiner*—Edward C. Favors
*Attorney, Agent, or Firm*—Darryl M. Springs

[57] ABSTRACT

An electrical ignition assembly for igniting flare gases and including at least a pair of spaced apart ignitor rods located adjacent the exit end of the stack, and an electrical control assembly for providing a spark across the pair of rods. The assembly may also be employed to light a flare pilot, if desired. In addition a pilot flame thermocouple and a stack flame thermocouple may be provided to monitor the system.

20 Claims, 8 Drawing Figures

FIG. 5
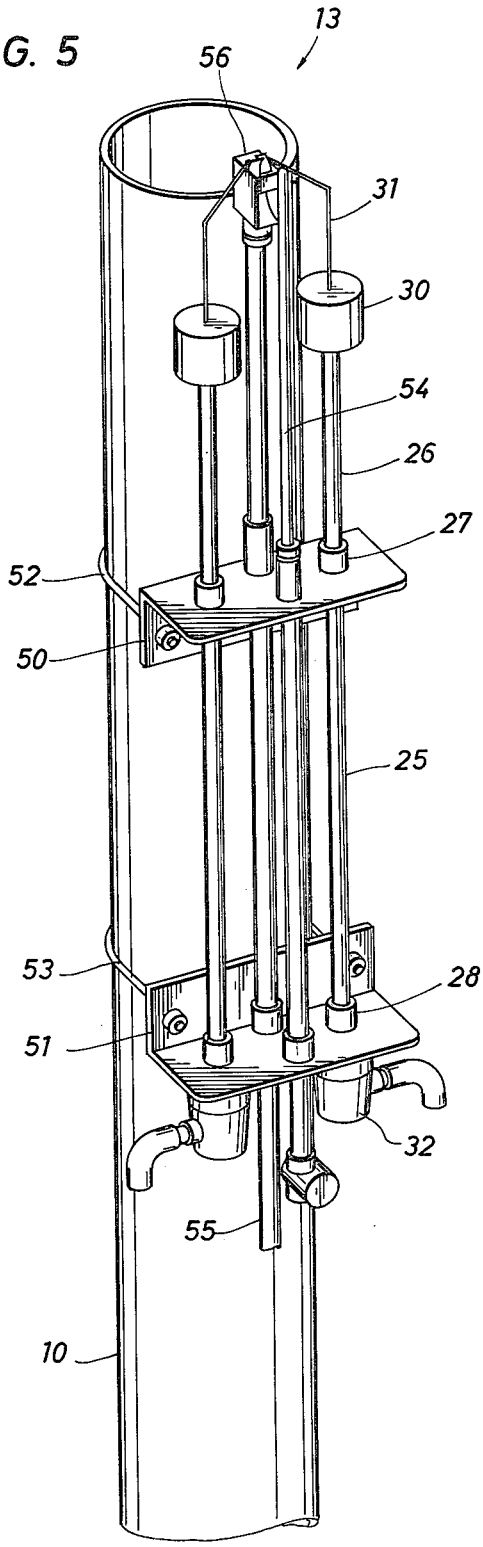
FIG. 6
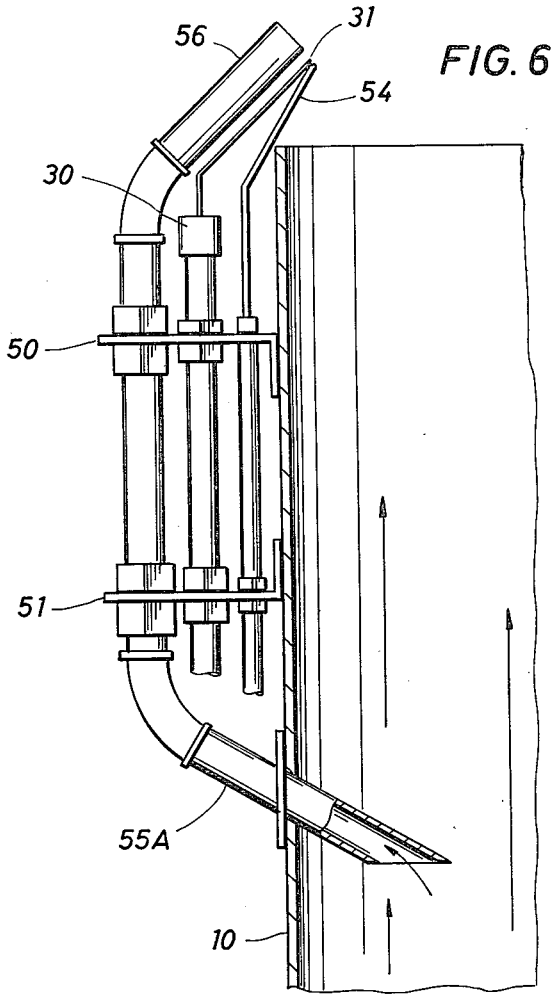
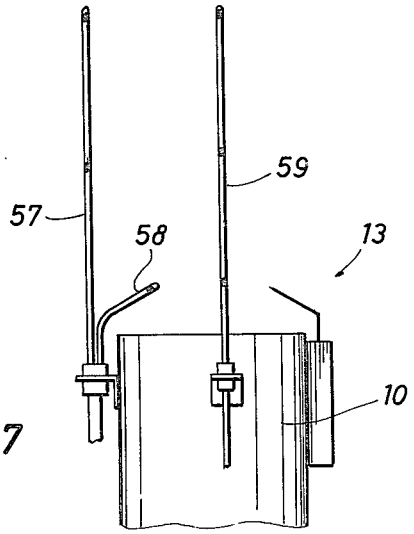
FIG. 7

IGNITION ASSEMBLY FOR FLARE STACKS

BACKGROUND OF THE INVENTION

The present invention relates to the ignition of gases that are combustible. More particularly, the present invention relates to an ignition assembly and the associated controls for the ignition of combustible gases resulting from the operation of chemical plants, refineries, pipelines, and oil field production units which produce combustible gases and which must be disposed of either continuously or intermittently through vertical or horizontal flare or vent pipes or stacks.

Many chemical plants, refineries, pipelines, loading docks, oilfield production units, off-shore drilling platforms, and other operations generate waste gases which must be disposed of through flaring and must be ignited so that the disposal is safe and effective. Often these waste gases are merely by-products of the process and are consistently produced in relatively constant volume. In other instances, because of upsets in plant operations, large quantities of gases such as feed materials, intermediates or products, must be disposed of quickly to prevent explosions or other hazardous conditions from occuring in the plant. Regardless of the source, however, the most commonly employed means of disposing of waste gases in the combustion thereof is generally by means of elevated flare stacks. The effectiveness and safety of this method of disposing of waste gases is dependent on igniting these gases either through a standing or intermittent pilot, or with a constant or intermittent electric ignition. Ignitor unit as used herein refers to that structure at the exit end of a flare or vent stack from which the waste gases pass and are ignited.

The present means of igniting waste gases at the end of a flare stack is with a constant burning pilot. Since a pilot uses natural gas or propane which is becoming more costly, a method of igniting either the pilot or a direct ignition of the flare gases by the use of an electrical ignitor is advantageous. The present method of ignition of a pilot at the top of a stack is mixing natural or propane gas and air at the ground level and igniting it and forcing this ignited gas up a long tube to a pilot at the top of the stack. This method, however, is not a positive method of ignition.

Other methods for igniting flare stack gases have been proposed and run the gamut from sending personnel up the stack to light the gas, to shooting fiery arrows across the top of the stack from ground level. It has been found, however, that these methods are at best ineffective and dangerous.

It has also been proposed to employ electrical means for igniting flare stack gases. However, electrical ignitors that have been used in the past have utilized single ignitor tips and have encountered the drawback in that severe shorting occurs in bad weather or with the build up of carbon material resulting from gas burning, with the result that no sparking occurs. Another with previous electric-type flare stack gas ignitors has been their inaccessible location. Thus, many have been mounted in a permanent fashion in order to render replacement difficult if not impossible, while others have been secured interiorly of the stack itself making repair and replacement hazardous.

These disadvantages of prior ignition methods are overcome with the present invention, and novel means and methods for electrically igniting the gas in a flare stack are herewith provided whereby an ignition spark across at least a pair of ignitor rods is provided and which may be controlled from ground level or from some remote site.

SUMMARY OF THE INVENTION

In an ideal embodiment of this invention, an electrical ignitor assembly is provided and which includes at least one pair of spaced apart ignitor rods located adjacent the exit end of the stack. The assembly is so constructed and arranged as to be easily accessible for removal whereby the ignitor rods may be replaced or repaired.

A suitable electrical control assembly will also preferably be included, and which is located at the base of the flare stack or at some remote site for actuating the spark across the gap between the two ignitor rods.

The electrical control assembly is preferably provided with a transformer for each pair of set of ignitor rods. Obviously, more than one set of ignitor rods may be provided, and, two sets spaced 180° apart is preferred although three may be used at 120° intervals. It should be apparent that more than one set of ignitor rods are required since at times wind conditions will carry the flare stack gas away from a single ignitor. Where more than one ignitor set is provided, however, the wind driven flare stack gas is interrupted by one or the other of the ignitor rod sets. In any event, at least one transformer will be required for each ignitor rod set.

In the ideal embodiment, the ignitor rods are constructed of a suitable low nickel content material and sheathed with a ceramic material and the transformer for each ignitor rod set provides a 10,000 volt spark. Adjustable timers may also be provided in conjunction with the control assembly whereby the spark duration may be set for predetermined time sequences.

It is therefore a feature of the present invention to provide a new and improved method of electrically igniting flare gases and vent gases and/or pilots at the exit of flare or vent stacks.

It is a further feature of the present invention to provide an electrical means of lighting flare gases and/or pilots that is servicable, and that minimizes the possibility of grounding in order to make the assembly more reliable.

It is also a feature of this invention to use a plurality of ignition units to effectively ignite the vent or flare waste gases regardless of the wind velocity and direction.

Yet another feature of the present invention is to provide an ignition assembly that can withstand the high temperatures involved at the top of flare or vent stacks when the waste gases are burning, and to provide an ignition assembly where the ignitor rods will stand up in the combustion of sour gases which gases have a quantity of hydrogen sulfide in them.

It is still another feature of this invention to provide a means of further minimizing possiblity of grounding of ignitor rods through the use of an ignitor cap, and to provide an assembly of an ignitor cap and ignition rod at the top of the unit that is replaceable in the field to make it easy to service.

These and other features and advantages of the present invention will become apparent from the following detailed description, wherein reference is made to the accompanying drawings.

IN THE DRAWINGS

FIG. 5 is a pictorial representation of another type of ignition assembly similar to that shown in FIGS. 1 and 2 but including a pilot feature.

FIG. 6 is a pictorial representation of a modification of the ignition system of FIG. 5 and wherein a stack gas bypass is provided.

FIG. 7 is a view of a stack gas monitoring system usable with any of the embodiments of FIGS. 1, 5 and 6, and including a series of thermocouples.

DETAILED DESCRIPTION

Figure 1:
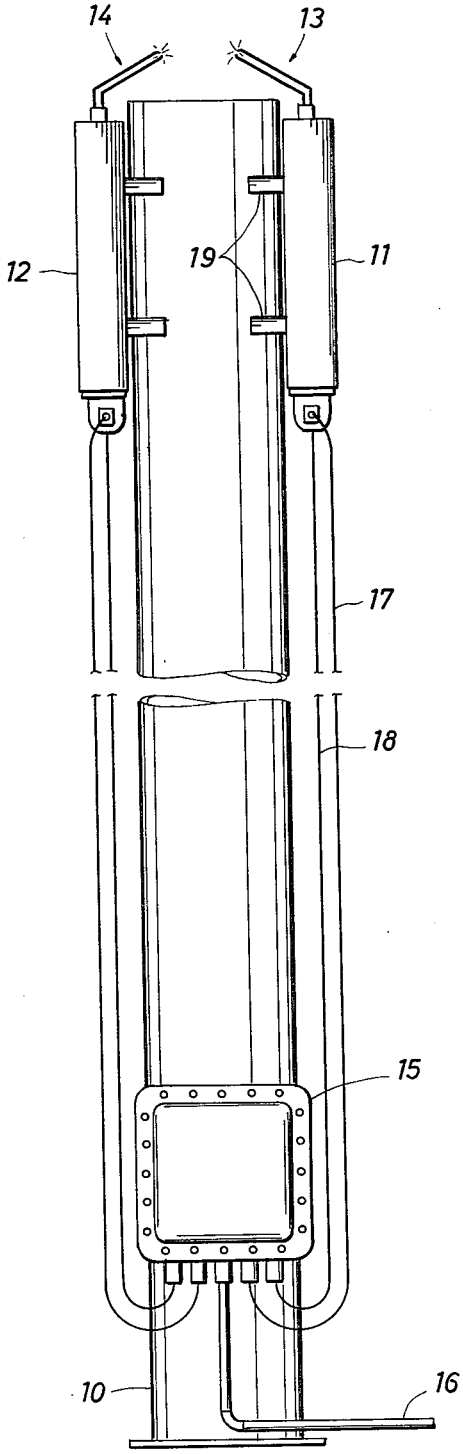
FIG. 1 is a simplified pictorial representation of a pair of electric ignitor rod assemblies mounted at the upper end of a flare stack and including the control assembly at the lower end of the stack.

Referring now to FIG. 1, there may be seen a simplified representation of a dual-type electrical ignition system for a flare gas stack of the type hereinbefore discussed. More particularly, the assembly may be seen to be composed of two ignitor rod pairs noted at 13 and 14 and mounted to flare stack 10 via housing assemblies 11 and 12. The housing assemblies are removably mounted to the stack 10 for easy removal therefrom as by stud bolts, and the ignitor rods of assemblies 13 and 15 are removably mounted within housings 11 and 12 to facilitate repair and replacement as will be described hereinafter.

The electrical control assembly for the ignitor rod pair sets is shown at 15 and is mounted to the bottom of the flare stack 10 for ease of access. The lead 16 extends to a source of power and each ignitor assembly includes two leads 17 and 18 extending to control box 15.

Referring again to FIG. 1, there may be seen that the two ignitor rod assemblies 13 and 14 spaced 180° apart and about the circumference of the top of flare stack 10. Obviously, there may be provided three assemblies in which case a spacing of 120° would be necessitated. In any event, more than one assembly is preferred since in some cases wind conditions may force the flare stack gas away from any one particular ignitor assembly. Again, as seen in FIG. 1, the flare stack 10 may include a pair of cross-braces 19 for suitably and removably mounting the housings 11 and 12 of each assembly. Thus, either housing 11 or 12 may be removed by unbolting that housing from its respective pair of braces 19. It should further be noted that the housings are mounted on the flare stack 10 to provide a flow path of the stack gases across the ignitor rods of each assembly. Thus, the tops of each set of ignitor rods are bent inwardly to present the spark to the gases as they travel thereby.

Figure 2:
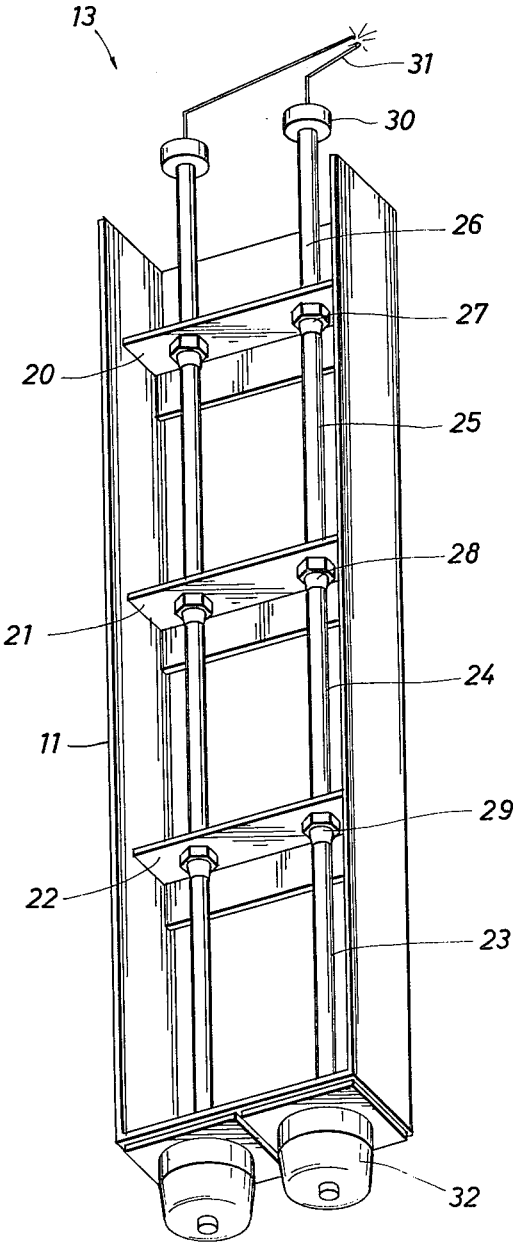
FIG. 2 is a simple but more particular isometric pictorial representation of one type of ignitor rod assembly depicted generally in FIG. 1.

Referring now to FIG. 2, there may be seen a more detailed pictorial illustration of one of the ignitor assemblies depicted in FIG. 1, and wherein the housing 11 is seen to comprise an open channel-type member and including a plurality of spaced horizontal shelves 20–22. Each ignitor rod comprises a series of four stacked units 23–26 supported by and extending through shelves 20–22. Each of the units 23–26 comprise an ignition rod encased in ceramic and including threaded ends whereby four of these units may be assembled within housing 11. The ignitor rods 23–26 are maintained within the shelves 20–22 by a series of locknut sets 27–29 which securely but removably mount each ignitor rod 23–26. Removably connected to the upper ignitor rod unit 26 is an insulator cap 30 which includes an ignitor rod tip 31. The material of tip 31 is preferably a metal or alloy containing little or no nickel to avoid tip degradation due to hydrogen sulfide present in most flare gases. Metals usable in accordance with the present invention include the welding rod material sold under the trademark E-BRITE by Airco Vacuum Metals Company.

The rod length 31 is flexible, and may be bent to any desired angle to set the gap between the two upper tip sections 31. The insulation cap 30 provides a threaded or other suitable means of removably attaching ignitor tips 31 to the ends of ignitor rods 26, to facilitate removal of the ignitor tips 31 for service or repair and replacement. For most purposes, a gap of one-quarter inch has been found to be sufficient. Disposed below the housing 11 is an explosion proof cap 32 for closing off the wiring attached to the lowermost unit 23 of the ignitor rod assembly. A suitable outlet is provided in cap 32 for extension of the leads 17 and 18 to the control panel 15.

While the extended tip portion 31 of the ignitor has been disclosed as being of a low nickel content material, any conductive metal may be used as the rod for either of units 23–26 depending on the environment of gases in which the tips must function. The only requirement being that the conductive rods be coated or sheathed in ceramic for electrical and thermal insulation, and include screw threaded male and female ends whereby the four units 23–26 and cap element 30 and tip 31 can be joined together as a single assembly. The housing 11 and shelve assemblies 20–22 are preferably of heavy plate steel that has been zinc galvanized or stainless steel or other suitable corrosion resistant material and all wiring is preferably of polyethylene insulated copper or stainless steel wire and having a flameproof polyvinylchloride jacket.

Figure 3:
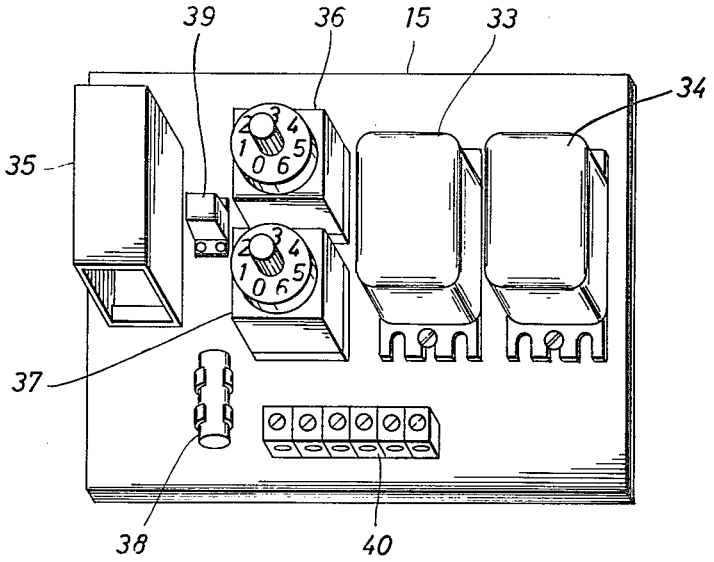
FIG. 3 is a simplified but different view in isometric of the control assembly depicted in FIG. 1 but with the cover removed.

Referring now to FIG. 3, there may be seen a detailed illustration of the electrical control unit 15 generally shown in FIG. 1 but with the cover removed to reveal the various components therein. Thus, there will be seen a pair of transformers 33 and 34 (isolated to float above ground) provided for each ignitor rod assembly 13 and 14. There is also housed in unit 15 a pair of timers 36 and 37, a silicon controlled rectifier 35, power switch 39, fuse 38, and contact bank 40. It should be apparent that by removing the cover from assembly 15 all components of the control unit are easily accessible. In addition, where three spaced apart ignitor rod assemblies are provided, control unit will carry three transformers rather than two as shown. In addition, it should be obvious that where remote control is desired, the housing 15 may be installed at some other site as a control room, for example. By way of example, a suitable transformer may comprise a Webster No. 312-25A02V (Ignition 120/10000), whereas the power contactor 35 may comprise the Payne Model 11D-2-10. A convenient contactor fuse 38 has been found to be a Payne No. 49B-25, 10 amp. In addition, as timers, the "Six Range" Tenor timers have been found suitable for present purposes. Obviously other equivalent components could be employed with the aforementioned only being preferable.

Figure 4:
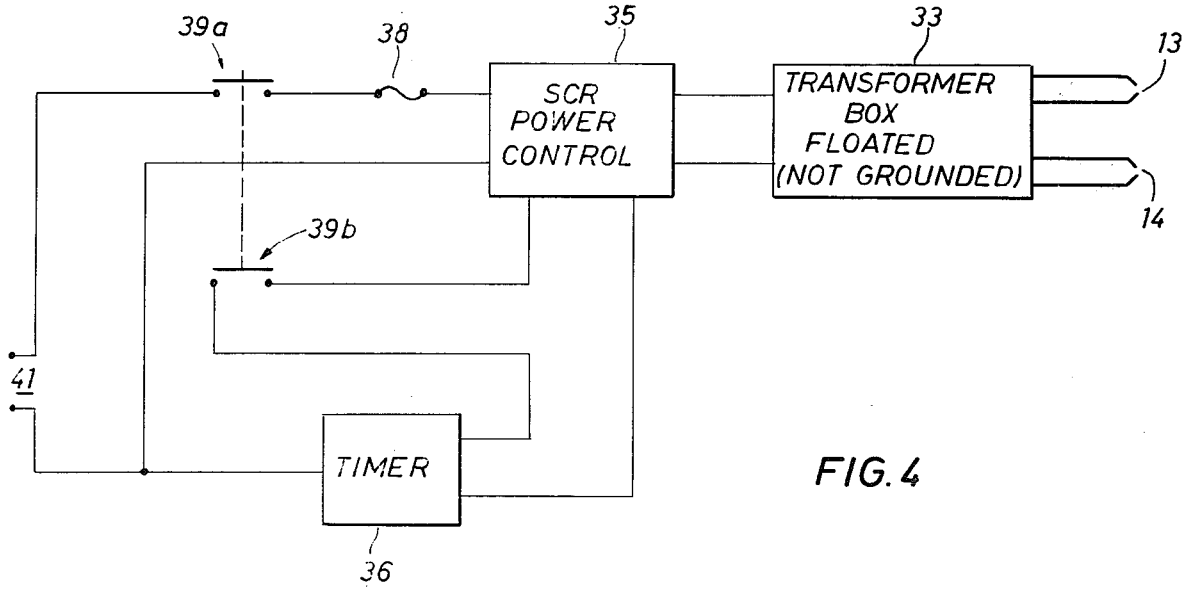
FIG. 4 is a functional diagram of the electrical components of the control assembly employed in the ignitor system embodying the concepts of the present invention.

With reference now to FIG. 4, there will be seen the details of the functional wiring diagram of the electrical control assembly of the present invention depicted generally in FIG. 3. Thus, there is seen a commercial power supply 41, typically a 120 volt/60 cycle supply with one terminal connected through power switch 39*a* and fuse 38 to a first input terminal of silicon control rectifier (SCR) power control circuit 35. Of course, other AC voltages and supplies may be provided, or rectified to DC or supplied by battery. A second terminal of power supply 41 is connected to SCR power control 35 and to timer 36. The output from timer 36 is connected to the control circuit of SCR power control 35 via control switch 39*b*. The output from SCR power control 35 is connected to transformer box 33 where the voltage is typically raised from 120 volts to about 10,000 volts for producing a spark between the gaps of ignitor rods 13 and 14. The transformers of transformer box 33 are isolated to float above ground to prevent a short circuit of the entire power supply upon inadvertent grounding of one of the ignitor rods 13 or 14.

Thus, when switch 39 is closed, power switch 39*a* and control switch 39*b* are closed, to simultaneously energize one terminal of SCR power control 35 and timer 36. After a predetermined time, the output from timer 36 is energized and applied to the control circuit of SCR power control 35. This output voltage is raised by transformers 33 to a voltage sufficient to produce a spark between the ignition rod 13 and 14 gaps. Sparking continues for a predetermined and preselected interval whereupon timer 36 de-energizes the output to the control circuit of SCR power control 35 and cuts off the output from SCR power control 35 thus arresting the spark. If desired, a second timer may be used to re-energize the ignition rods at a second preselected time to insure complete combusion of the flare stack gases.

With reference now to FIG. 5, there is depicted therein a modified ignitor assembly similar to that set forth in FIG. 2 and described above but including a pilot feature. For simplicity, identical numerals have been used in FIG. 5 to indicate elements of the assembly that have been previously described. Thus, there will be seen in FIG. 5 the ignitor assembly 13 mounted to stack 10 and including the ignitor rod pairs 25, 26 as described hereinabove. The assembly is attached to stack 10 via a pair of angle members 50, 51 secured in turn to the stack by U-bolts 52, 53. Extending vertically along the stack 10 will be seen a thermocouple 54, a gas supply line 55, and a pilot 56 in communication with the upper end of gas line 55. Thermocouple assembly 54 is mounted to monitor the presence of a flame of the pilot 56, and the leads of thermocouple assembly 54 are in turn connected to the control circuitry to be described hereinafter. While only a single assembly 13 is depicted in FIG. 5, two or more may be provided in spaced apart relationship about stack 10. In addition, it should be noted that the ignitor tips 31 are bent to a fashion whereby the spark produced thereacross will ignite the gas escaping from the pilot 56. Thereafter, the flame of the pilot 56 functions as the ignitor for the stack gases. Where it is not desired to use the pilot 56, however, the ignitor tips 31 may be actuated to ignite the flare gas. Thus, a dual system is provided wherein the stack gas is ignited directly via the spark of the ignitor tips, or the ignitor tips are used to ignite the pilot gas and the pilot flame whereby provides the ignition. In the latter case, the thermocouple assembly 54 serves the purpose of providing an indication that the pilot 56 is in fact lit.

The same low nickel material is used in the construction of thermocouple sheathing of thermocouple assembly 54. This material possesses the advantage in that it does not deteriorate in the presence of gases containing hydrogen sulfide and possesses good thermal conductivity. When it is desired to conserve gas, the independent supply 55 of pilot gas may be dispensed with, and the pilot gas may be drawn directly from the stack by means of a bypass line 55A as illustrated for example in FIG. 6. Otherwise, the details of FIG. 6 are identical to that described above with respect to FIG. 5. While the pilot 56 has been shown in FIG. 5 as the split-flow type, and as the single flow type in FIG. 6, other conventional pilot systems may be employed for purposes of the present invention.

With reference now to FIG. 7, there is therein illustrated a monitoring system for the stack flame and will be seen to comprise a three zone thermocouple monitor 59 attached to the upper end of stack 10 in spaced relationship to ignitor assembly 13. By using this three zone monitor, not only the height but the intensity and presence of the stack flame at different levels may be monitored. As an alternative to the three zone thermocouple 59, there may be provided a dual zone thermocouple 57 in combination with a single lower zone monitoring thermocouple 58. In any event it is preferred, as noted above, to construct the thermocouple sheathing of E-BRITE material. The multiple zone thermocouples would be electrically wired in parallel to provide a signal path upon actuation of any one of the thermocouples in the assembly.

Figure 8:
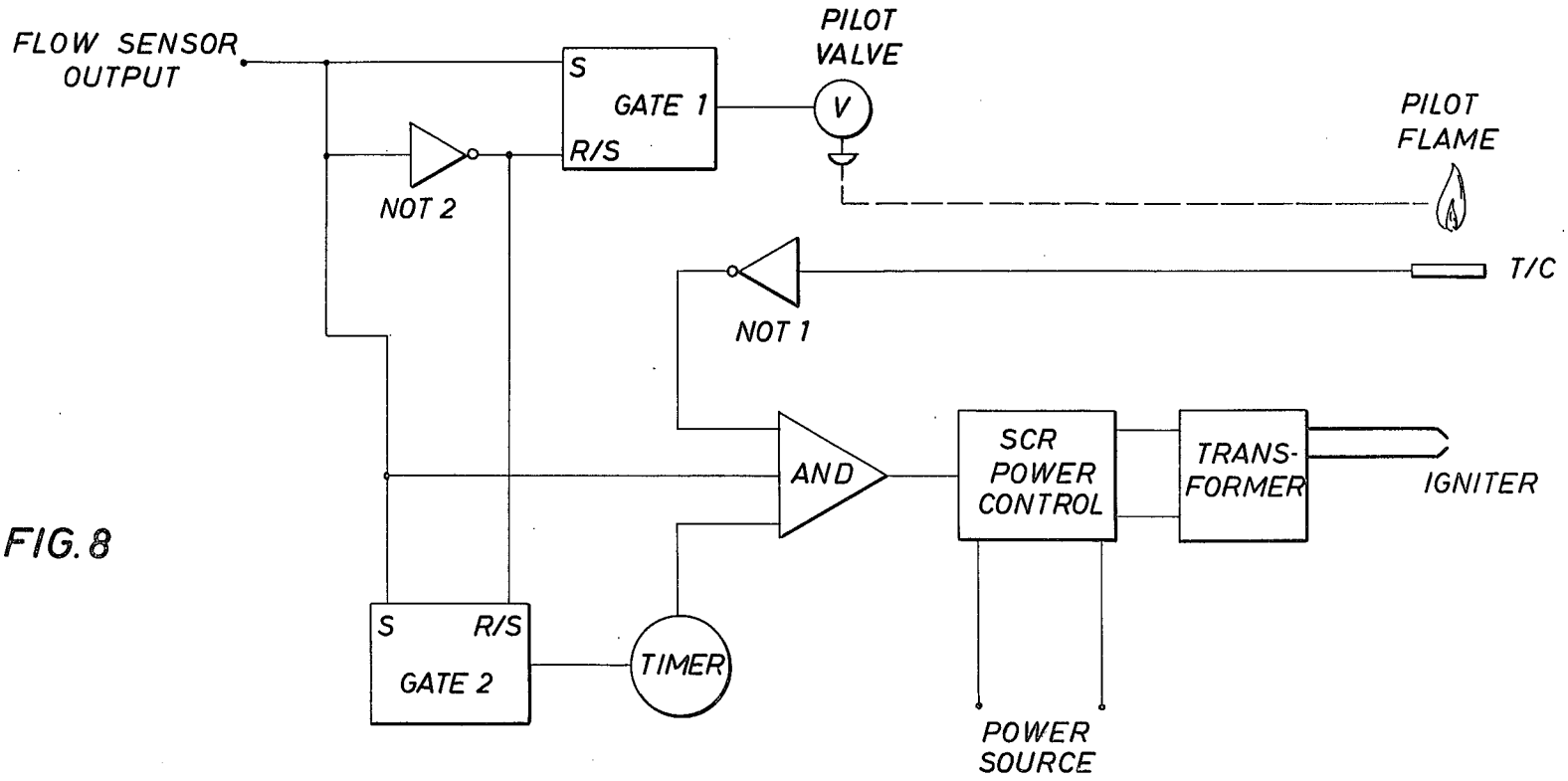
FIG. 8 is a functional diagram of the control circuitry that may be provided to operate the ignition system in a variety of sequences.

Referring now to FIG. 8, there may be seen a schematic diagram of a composite control system for the ignition system of the present invention. The control system can be arranged to enable the SCR power control circuit to energize the ignitor based on a variety of conditions: (1) a manual switch (not shown) may be employed; (2) a timer may be employed to actuate the ignitor at preselected intervals; (3) a stack gas flow sensor may be used to permit or initiate ignition only when there is a discharge gas present in the flare stack; (4) and a thermocouple input may be provided to sense the presence of burning flare gas or the absence of a burning pilot flame to initiate the ignition sequence.

In the embodiment shown in FIG. 8, the flare gas is ignited by means of a pilot flame. To initiate the pilot flame, the control system receives a first input from the flow sensor output to signal the presence of flare gas to be burned. The flow sensor output sets gate 1 to actuate the pilot valve and provide a supply of combustible gas for the pilot flame. Simultaneously, the flow sensor output signal sets gate 2 to initiate an output from the timer and provide a first input to the three-input AND gate. A second input to the AND gate is presented from the timer. A thermocouple is further provided to sense the presence of a first NOT gate so that an output from said NOT gate is available to complete the inputs to the AND gate in the absence of a pilot flame. Accordingly, an output from the AND gate is provided to initiate ignition upon the concurrence of (1) flow in the flare stack, (2) timer output, and (3) lack of a pilot flame. Ignition continues until an output from the thermocouple results in a loss of output from the first NOT gate or for a preselected interval after which the output signal from the timer terminates. If the flow of flare gas ceases, an output is obtained from the second NOT gate to reset gate 1 and produce pilot valve closure and to reset gate 2 to disable the timer.

If it is desired to ignite the flare gas directly, the same control circuit may be used but without the pilot valve and control. Therefore, in this instance, the thermocouple detects the presence of burning flare gas such that ignition does not occur when the gas is already burning. In that event, a three zone thermocouple assembly 59 or a combination of the two zone thermocouple assembly 57 and thermocouple assembly 58 may be utilized with the circuit disclosed in FIG. 8. The multiple thermocouple assemblies would be electrically wired in parallel to provide an output to NOT 1 gate if any one of the zones thermocouples is actuated.

Other alternate configurations of the control system hereinabove discussed may be readily apparent. For example, the thermocouple may be omitted whereby ignition is determined by the occurrence of a flow of the flare gas and for preselected periods or intervals of time. Further, if the flow of vent gas is generally continuous, the flow sensor may be deleted and ignition determined by the thermocouple output and for preselected intervals. FIG. 4 shows yet another embodiment where ignition is manually initiated and continues for a preselected, timed interval.

Many other modifications and alternatives to the apparatus and techniques hereinbefore described will be readily apparent to those of ordinary skill in this art. Accordingly, the structures and techniques described herein and depicted in the accompanying drawings are intended to be exemplary only and are not intended as limitations on the scope of this invention.

What is claimed is:

1. Apparatus for igniting waste gases flowing from an exhaust exit, of a flare gas stack comprising:

an ignition assembly for said gases including at least one pair of spaced apart ignitor rods located adjacent said exhaust exit, and means for selectively energizing said at least one pair of ignitor rods with a voltage sufficient to produce a spark for ignition of said flowing gas.

2. The apparatus described in claim 1 wherein transformer means is interconnected to said ignition assembly for increasing a selected input power voltage to a voltage sufficient to produce a spark across said ignitor rods.

3. The apparatus as described in claim 2, wherein said transformer means is isolated to float above ground potential.

4. The apparatus described in claim 2 further including a power relay circuit and timer means connected to said transformer means for selectively enabling an output from said power relay circuit to said transformer means.

5. The apparatus as described in claim 1, including a plurality of pairs of spaced apart ignitor rods located adjacent said exhaust exit and spaced generally equidistant of each other.

6. The apparatus described in claim 1 and wherein said energizing means is located at the base of said stack.

7. The apparatus described in claim 5, wherein said energizing means is located at the base of said stack.

8. The apparatus described in claim 1 wherein said energizing means is located at a site remote from said stack.

9. The apparatus described in claim 5 wherein said energizing means is located at a site remote from said stack.

10. The apparatus described in claim 1 and including thermocouple means associated with said ignition assembly for actuating said energizing means upon absence of a gas flame.

11. The apparatus described in claim 1 wherein each ignitor rod comprises:

a length of conductive metal rod, means for electrically and thermally insulating said rod, an ignitor tip of conductive material removably attachable to said length of conductive metal, and an insulating block surrounding the junction of said rod and said tip.

12. The apparatus described in claim 11, wherein said electrical and thermal means insulation is a ceramic material.

13. The apparatus described in claim 11, and including:

a housing for said rods, and means for removably attaching said housing to said exhaust exit.

14. The apparatus described in claim 1, including:

pilot means cooperating with said ignition assembly for ignition by said assembly, and a thermocouple located adjacent said pilot means to monitor the ignition of said pilot means.

15. The apparatus as described in claim 14, wherein said thermocouple is sheathed in a no nickel content metal material for reducing deterioration due to the presence of hydrogen sulfide in the waste gas.

16. The apparatus described in claim 1, wherein a thermocouple assembly having a plurality of thermocouples for monitoring a plurality of heat zones is mounted at a site adjacent the exhaust exit and spaced from said ignitor rods for detecting a flare gas flame at a plurality of spaced points from said exhaust exit.

17. The apparatus described in claim 16, wherein said thermocouple assembly is sheathed in a no nickel content metal material in order to reduce deterioration due to the presence of hydrogen sulfide in the waste gas.

18. Apparatus for igniting waste gases flowing from an exhaust exit of a flare gas stack, comprising:

an ignition assembly for said gases including at least one pair of spaced apart ignitor rods located adjacent said exhaust exit, means for selectively energizing said at least one pair of ignitor rods with a voltage sufficient to produce a spark for ignition of said flowing gas, and pilot means, including by-pass means to feed waste gases from said exhaust exit to said pilot means, cooperating with said ignition assembly for ignition by said assembly.

19. As a subcombination, a thermocouple assembly having a plurality of thermocouples for monitoring a plurality of spaced heat zones, each thermocouple mounted within the same elongated body a different preselected distance from one end of said elongated body, said one end of said elongated body mountable adjacent the exhaust exit of a flare gas stack and oriented to position each thermocouple a different preselected distance from said exhaust exit.

20. The subcombination disclosed in claim 19, wherein said elongated body is an elongated tubular sheath constructed of a no nickel content metal material in order to reduce deterioration due to the presence of hydrogen sulfide in waste gas emitted from said exhaust exit.

* * * * *